US006095579A

United States Patent [19]

Nichols

[11] Patent Number: 6,095,579

[45] Date of Patent: Aug. 1, 2000

[54] WASTE COLLECTION DEVICE

[75] Inventor: Donald E. Nichols, Shelton, Wash.

[73] Assignee: Coyote Enterprises, L.L.C., Bellevue, Wash.

[21] Appl. No.: 09/006,695

[22] Filed: Jan. 14, 1998

Related U.S. Application Data

[60] Provisional application No. 60/036,098, Jan. 14, 1997.

[51] Int. Cl.[7] ..... A01K 29/00; E01H 1/12

[52] U.S. Cl. ..... 294/1.3; 15/104.8

[58] Field of Search ..... 294/1.3–1.5, 8.5, 294/11, 16, 50.8, 50.9, 55; 15/104.8, 257.1, 257.2, 257.4, 257.6, 257.7; 56/400.11, 400.12; 119/161; D30/161, 162

[56] References Cited

U.S. PATENT DOCUMENTS

| | | | |
|---|---|---|---|
| 3,718,358 | 2/1973 | Ayers | 294/1.4 |
| 3,879,079 | 4/1975 | Nicholas | 294/1.4 |
| 3,977,715 | 8/1976 | Casci | 294/1.4 |
| 4,159,139 | 6/1979 | Gawedzinski | 294/1.4 X |
| 4,196,928 | 4/1980 | Spangler | 294/55 |
| 4,200,321 | 4/1980 | Warkentin | 294/1.4 |
| 4,349,224 | 9/1982 | Shiozaki | 294/1.4 |
| 5,031,948 | 7/1991 | Groth et al. | 294/55 X |

FOREIGN PATENT DOCUMENTS

| | | | |
|---|---|---|---|
| 1196938 | 11/1985 | Canada | 294/1.3 |
| 4106446 | 9/1992 | Germany | 294/1.3 |

*Primary Examiner*—Johnny D. Cherry
*Attorney, Agent, or Firm*—R. Reams Goodloe, Jr.

[57] ABSTRACT

A waste collection device having a mouth opening is removably attached to a first strut. A rake with curved teeth is affixed to a second strut. The first and second struts are pivotally connected and biased in a normally open position with the rake and waste container urged apart. The rake and waste container are manipulated using a handle assembly fixedly attached to the proximal end of the first strut. The rake is mounted lengthwise and laterally in a manner so that the rake interfaces with the forward opening mouth of the waste container so as to be in a position to effectively urge solid waste toward the mouth of the waste container, when the rake and container are placed on opposing sides of solid waste lying on a substantially planar surface, and the device is manipulated to a closed position with the rake and waste container in close proximity. A gravity latch may be provided to releasably lock the rake in a closed position, as well as to function as a guide for the second strut and rake. The waste collection device provides improved ergonometric operation for a waste collection device.

45 Claims, 6 Drawing Sheets

WASTE COLLECTION DEVICE

This application claims the benefit of U.S. Provisional Application No. 60/036,098 filed Jan. 14, 1997.

A portion of the disclosure of this patent document contains material which is subject to copyright protection. The owner has no objection to the facsimile reproduction by anyone of the patent document or the patent disclosure, as it appears in the Patent and Trademark Office patent file or records, but otherwise reserves all copyright rights whatsoever.

TECHNICAL FIELD OF THE INVENTION

This invention relates to novel, improved devices for collection of small deposits of solid waste. Devices of that character are particularly well suited for use in collecting feces left behind by pets, particularly dogs.

BACKGROUND OF THE INVENTION

A continuing demand exists for a simple, inexpensive mechanical device which can be used to collect waste droppings left behind by pets. In fact, many communities now have regulations in place which require pet owners to clean up the wastes left behind by their pets, particularly in public places such as city streets and parks. It would be advantageous for pet owners subject to such regulations to have access to a simple device which enables the efficient and sanitary collection of such wastes.

Currently, in so far as I am aware, the majority of waste pick-up devices on the market generally require the operator to either bend down and stoop over to place a collection device near the waste, or to use both hands to manipulate the collection device. Several proprietors have recognized the need for a "no-stoop" type device that can be manipulated with a single hand, but unfortunately, such devices which are known to me have left something to be desired. Consequently, I have developed a novel waste collection device which enables single handed use, without stooping over, but which is superior to those earlier, somewhat similar devices known to me.

By providing a waste collection device operated by a single hand, it is possible to reduce the biomechanical stress and strain encountered, compared to users of prior art devices that have to bend over when collecting pet wastes. Therefore, my novel waste collection device enables the operator to efficiently manipulate the collection device, while avoiding musculoskeletal extremes of motion that might tend to cause stress and strain. This is particularly important to those with a limited range of motion, such as the old or infirm.

A few waste collection devices that are one-hand operable, and which provide some of the general capabilities desired, have heretofore been proposed. Those of which I am aware include those described in the following patents: U.S. Pat. No. 3,977,715 issued to Casci on Aug. 31, 1975 for a Pickup Kit for Animal Droppings; U.S. Pat. No. 4,196,928 issued to Spangler on Apr. 8, 1980 for a Material Pickup Device; and Canadian Patent No. 1,196,938 issued to Levesque on Nov. 19, 1985 for a Collector Bag for Waste on Ground.

The patent documents identified in the preceding paragraph disclose devices which do not provide a releasably affixable permanent waste collection container. Thus, they are inherently not well suited, as disclosed, for use of a plastic liner bag. Also, those prior art devices are, in general, unsuitable for picking up more than one pile of feces before they must be emptied. This is because most prior art devices have waste containers which lose their contents if opened to pick up a second set of droppings. In addition, in many prior art devices, the waste capturing force is moderated or limited by the force of a spring in a manner that is detrimental to manually increasing such waste pick-up-force. Such devices are undesirable on those occasions where additional raking pressure may be required. Finally, in so far as I am aware, waste collection containers in prior art products have not been removable for easy cleaning. The advantage of such a removable and cleanable waste collection container feature is important, and self-evident.

SUMMARY OF THE INVENTION

I have now invented, and disclose herein, a novel, single-hand operable waste collection device for use in the sanitary collection of fecal matter from pets. My device does not have the above-discussed drawbacks common to those heretofore used waste collection devices of which I am aware. Unlike pet waste collection devices heretofore available, my waste collection device is simple to operate with one hand, even from a standing position. It is relatively inexpensive, and is easy to use with disposable waste collection bags. It has a waste collection container which is easy to remove for inspection and cleaning, and is otherwise superior to the heretofore used or proposed waste collection devices of which I am aware.

My novel pet waste collection device differs from those earlier devices mentioned above in one respect in that I have now developed a waste collection device which is provided with a pair of long struts, each connected to a handle assembly. The first strut is fixedly attached to the handle assembly. At the lower end of the first strut, a waste collection container is releasably affixed thereto. The second strut is pivotally attached to the handle assembly. At the lower end of the second strut, a rake is attached. The length of the first and second struts is such that the waste collection container and rake interface at the ground, in a manner suitable so that the rake can urge a pile of feces into the waste collection container while the operator maintains a standing position. A handle, preferably designed to recess into the underside of the handle assembly, is configured with a lever arm connected to the second strut, so that once the collection device is positioned in a manner that the rake and the waste collection container are on opposite sides of a pile of feces, the handle can be squeezed to move the rake toward the waste collection container, to urge the feces into the open mouth of the waste collection container. Then, when the rake nearly reaches the open mouth of the waste collection container, a gravity latch engages the rake, holding the rake in the closed position. In this manner, spillage of the waste just collected is avoided.

For continued, i.e., repeated, operation of the waste collection device before emptying the same, the waste collection device is then lifted so that the struts are in a near horizontal position, with the rake vertically above the open end of the waste collection container. In this manner, any waste sticking to the rake will normally fall by gravity into the waste collection container. Also, in this position, a gentle squeeze of the handle will release the gravity latch, and thus release the rake. A spring within the handle assembly then pushes the rake away from the container to an "open" position, and the waste collection device can be maneuvered into a downward, vertically extended, waste pick-up position, ready for pick up of the next pile of feces.

My novel waste collection device is simple, durable, and relatively inexpensive to manufacture. It provides a significant measure of relief to the user from neck and back strain, by eliminating the need to bend over to operate a waste collection device, and thus it provides a significant improvement in pet waste collection devices.

OBJECTS, ADVANTAGES, AND FEATURES OF THE INVENTION

From the foregoing, it will be apparent to the reader that one important and primary object of the present invention resides in the provision of novel, improved pet waste collection devices which provide a means to collect wastes with a single hand from an upright, standing position, while improving the efficiency of waste collection operations.

Other important but more specific objects of the invention reside in the provision of a pet waste collection device, as described in the preceding paragraph which:

- is relatively simple, particularly in the waste capture and in the rake locking operation, to enable multiple waste pickups without the need to empty the device;
- in conjunction with the preceding object, has the advantage that it can be easily used with plastic bag liners in the waste collection container, thus simplifying waste disposal and reducing the spread of unpleasant odors and attendant cleaning requirements;
- has a rake which is easily displaceable by simple pressure from the operator's hand on the handle, so as to be selectively repositionable, yet allowing safe and secure operation;
- allows the rake and latch operation to be manually effected in a simple, easily repeated and secure manner.

Other important objects, features, and additional advantages of my invention will become apparent to the reader from the foregoing and from the appended claims and as the ensuing detailed description and discussion proceeds in conjunction with the accompanying drawing.

BRIEF DESCRIPTION OF THE DRAWING

In the drawing.

In the various figures of the drawing, identical features will be indicated with the same reference numerals, and similar features in alternate embodiments or locations will be indicated with use of prime (') superscripts, without further mention thereof.

DETAILED DESCRIPTION OF THE INVENTION

Figure 1:
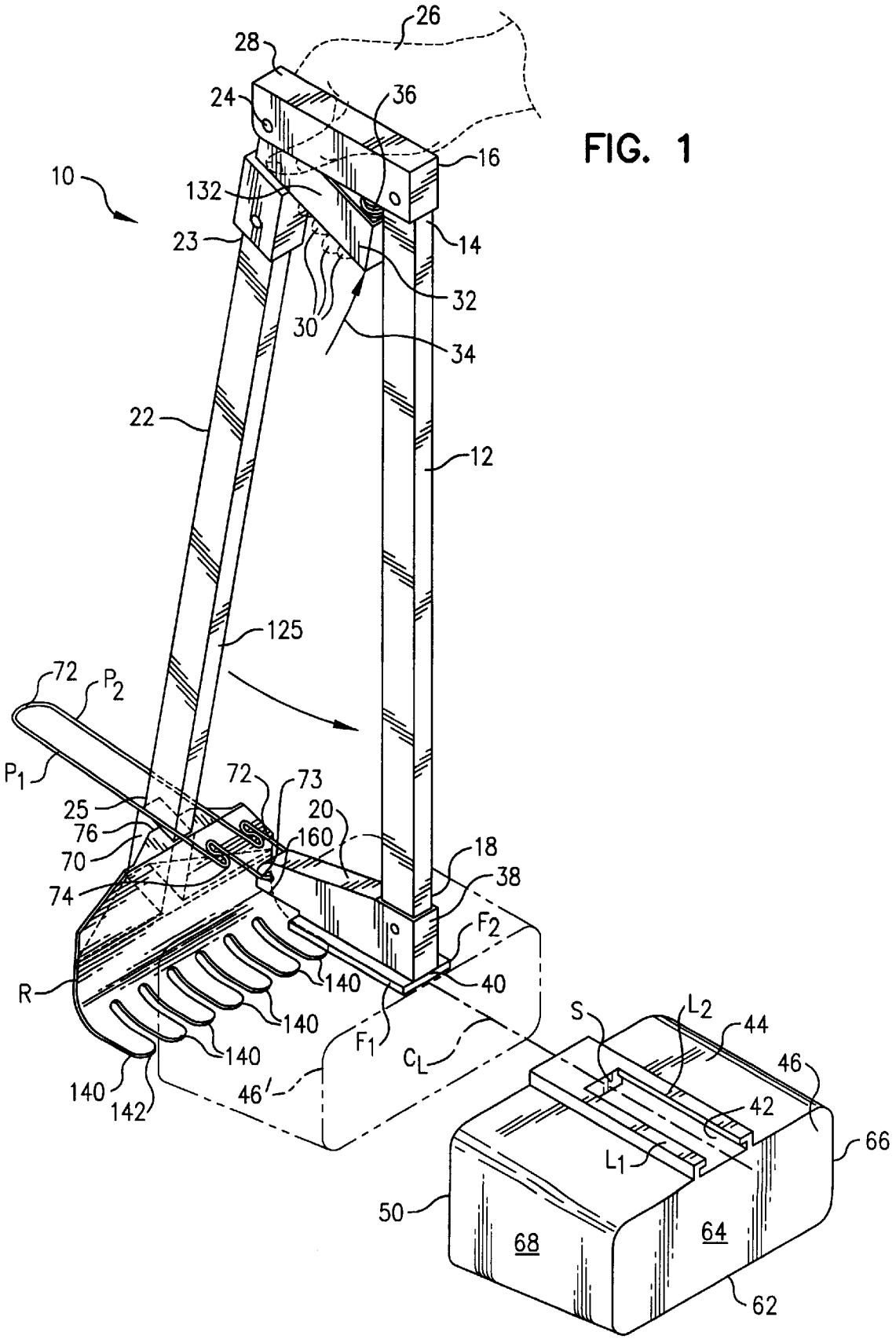
FIG. 1 is a perspective view of my waste collection device, showing the pair of vertically extending struts which are affixed downwardly from a handle assembly, the handle for moving the second strut and attached rake, the gravity latch for locking the rake in a closed position, the shoe assembly with attachment plate, and the waste collection container with integral, one-piece attachment keyway.

Referring now to the drawing, FIG. 1 depicts, in a vertical position, my waste collection device 10, as constructed in accord with, and embodying, the principles of the present invention. The waste collection device has a fixed, first strut 12 which has an upper end 14 that is fixedly attached to a handle assembly 16. First strut 12 extends lengthwise (downwardly as shown) to a lower end 18 that is fixedly attached to a shoe assembly 20. A moveable, second strut 22 is pivotally attached, at an upper or handle assembly end 23 to the handle assembly 16, at pivot 24. Rake R is provided at the lower or rake end 25 of the second strut 22.

The handle assembly 16 is preferably provided of sufficient length so that a distance D (see FIG. 2) is provided between first strut 12 and second strut 22, adequate for a hand 26 of an adult to easily fit over the top 28 of handle assembly 16 and grip, with fingers 30, the downwardly biased handle 32. Handle 32 is also preferably rigidly affixed to the second strut 22, so that by engaging the fingers 30 with the handle 32, the handle 32 may be pulled upward in the direction of reference arrow 34, to act against the downward biasing spring 36.

When the waste collection device 10 is setting on a suitable substrate 39 such as the ground, I find that the first strut 12 and second strut 22 should be provided in lengths which enable the top 28 of handle assembly 16 to rise an overall height H which is approximately twenty five (25) inches from the substrate 39. At the lower end 18 of the first strut 12, shoe assembly 20 is fixedly attached, preferably utilizing a strut attachment portion 38 of the shoe assembly 20 to interfittingly and snugly engage the lower end 18 of first strut 12. The shoe assembly 20 provides an interlocking shoe plate 40 that is sized to interfittingly engage an attachment keyway 42 located on the top wall 44 of a waste collection container 46, in order to removeably affix the waste collection container 46 to the shoe assembly 20. This interlocking arrangement can be better appreciated by reference to FIG. 2, which shows this aspect of the invention in vertical cross section as if taken across section 2—2 of FIG. 1. Preferably, the shoe plate 40 is provided in a downwardly oriented T configuration with laterally extending and inwardly running (toward rake R) flanges $F_1$ and $F_2$.

In such configuration, the attachment keyway 42 is defined by opposing, upwardly extending inverted L-shaped flanges $L_1$ and $L_2$ which extend inward at least across a portion of the top wall 44 and along a centerline $C_L$ formed therebetween. However, any convenient interlocking keyway arrangement can be used for attachment of the waste collection container 46. Ideally, the attachment keyway 42, namely flanges $L_1$ and $L_2$ thereof, are formed in an integral, one-piece fashion with the waste collection container 46, such as is possible with injected molded plastic like high density polyethylene ("HDPE"). To locate waste collection container 46 with respect to the shoe assembly 20, a keyway stop S is provided at the end of attachment keyway 42. Preferably, the keyway stop S and shoe plate 40 interact so that the waste collection container 46 is urged "on" as the container 46 is filled.

Figure 2:
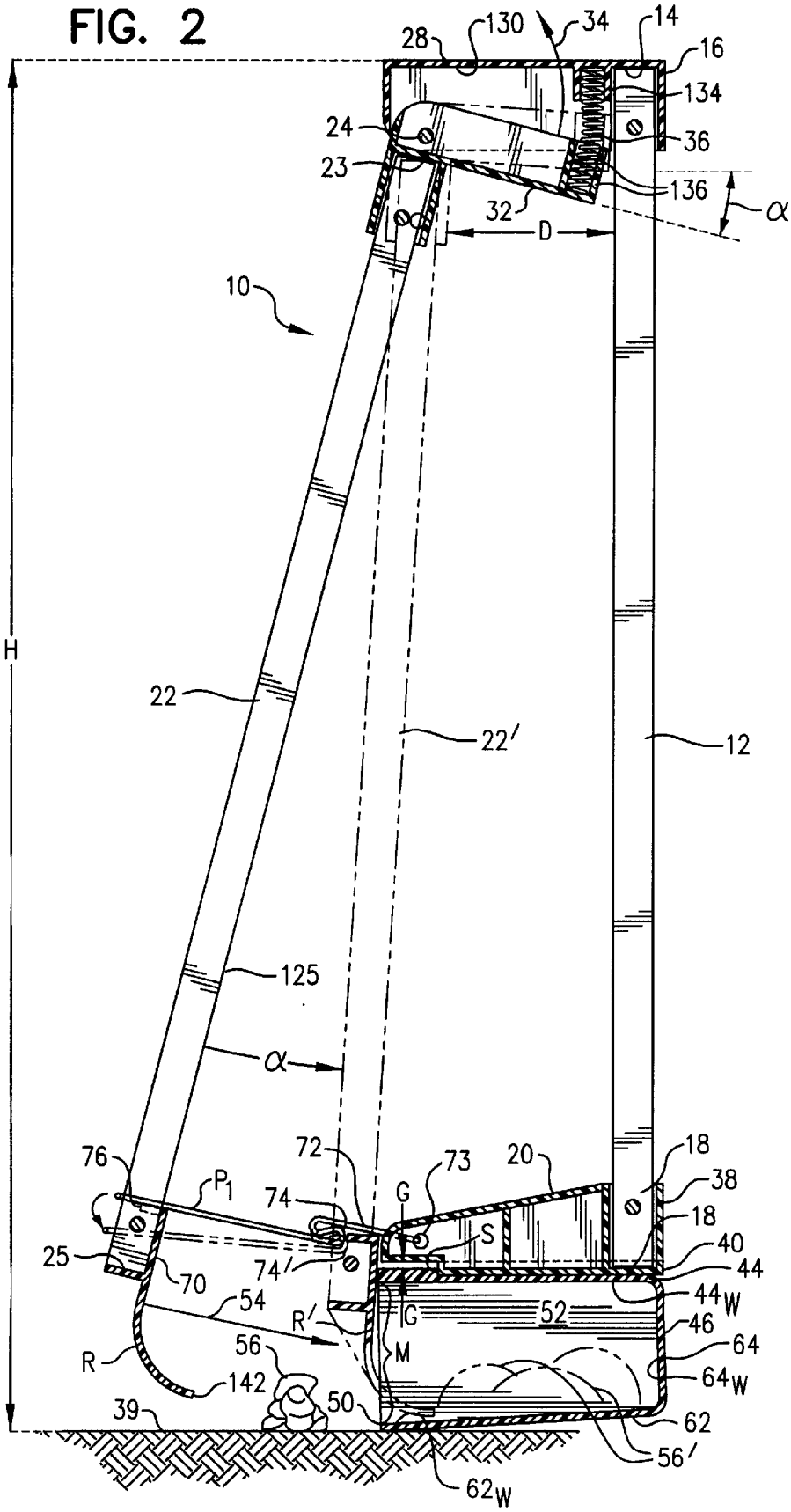
FIG. 2 is a vertical cross-sectional view of the waste collection device similar to that just set forth in FIG. 1, taken looking down through the handle and through the rake and waste collection container, to reveal details of the handle assembly and the handle, as well as the shoe assembly and waste collection container.

As better seen in FIG. 2, the waste collection container 46 has a front interior peripheral edge 50 which defines a mouth M for a rearward extending preferably enclosed container portion 52. As can be appreciated in this FIG. 2, by moving the second strut 12 rearward in the direction of reference arrow 54, rake R can be used to urge solid waste 56, such as fecal matter, into the enclosed container portion 52 of the waste collection container 46. It can be appreciated in this FIG. 2 that the rake R must be mounted lengthwise, with respect to the second strut 22, and laterally with respect to the waste collection container 46, in a manner so that the rake R interfaces with the front interior peripheral edge 50 of the waste collection container 46, so that the rake R is in a position to effectively urge the solid waste 56 through mouth M and toward the rearward extending container portion 52 of the waste collection container 46, to a position indicated by reference numeral 56', when the rake R and the waste collection container 46 are placed on opposing sides of solid waste 56 that is resting upon a substrate 39. The rearward extending container portion 52 is better defined by the interior wall surface portions of the waste collection container 46. Container 46 has a bottom wall 62, a rear wall 64, left 66 and right 68 opposing sidewalls, and a top wall 44. The interior wall surface portions of these walls are, respectively, designated by reference numerals $\mathbf{62}_W$, $\mathbf{64}_W$, $\mathbf{66}_W$, $\mathbf{68}_W$, and $\mathbf{44}_W$.

I prefer to use a rake R of the type where the rake R has a rake attachment portion 70 which is adapted for tight fitting engagement with the rake end 25 of the second strut 22. By using this method, the rake attachment portion 70 provides an easy assembly guide for fixedly attaching the rake R to the second strut 22, and increases the strength of the attachment for the rake R.

Figure 4:
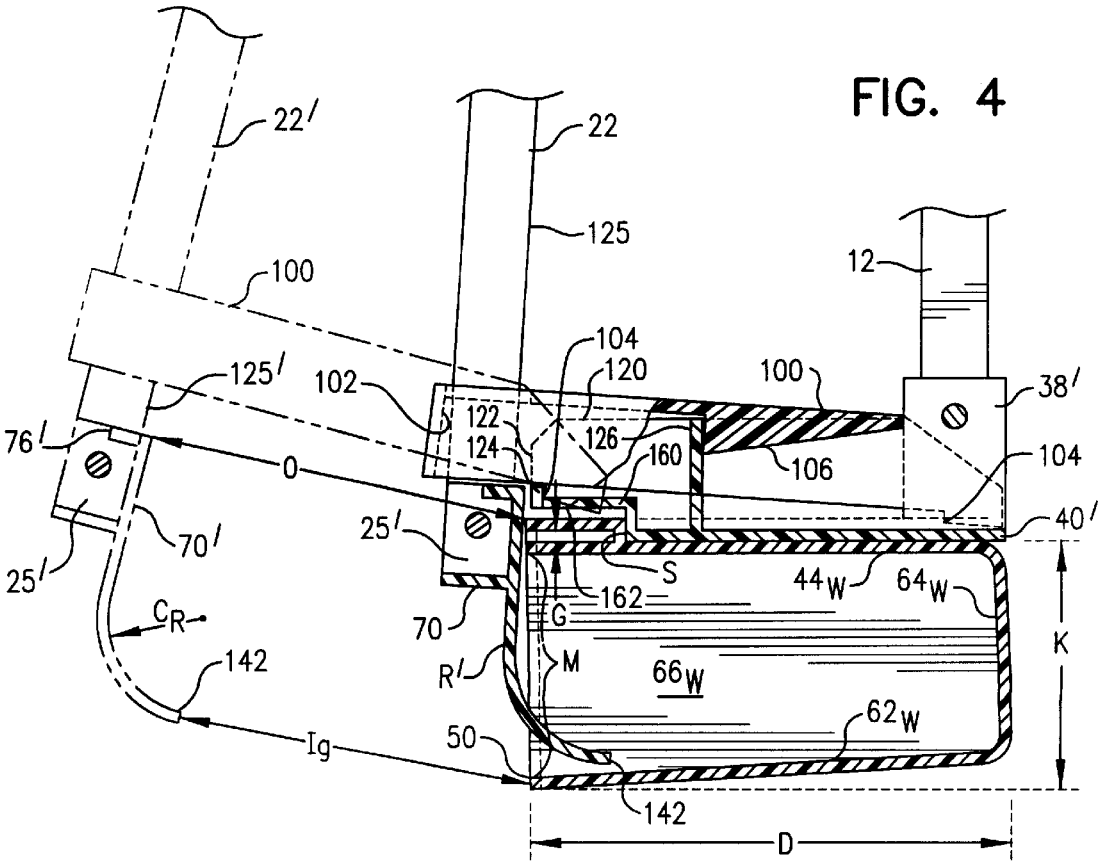
FIG. 4 is a partial cross-sectional view, showing the details of a second embodiment of a gravity latch mechanism, with the gravity latch in an open position in phantom lines, and in a closed and locked position in solid lines.
Figure 5:
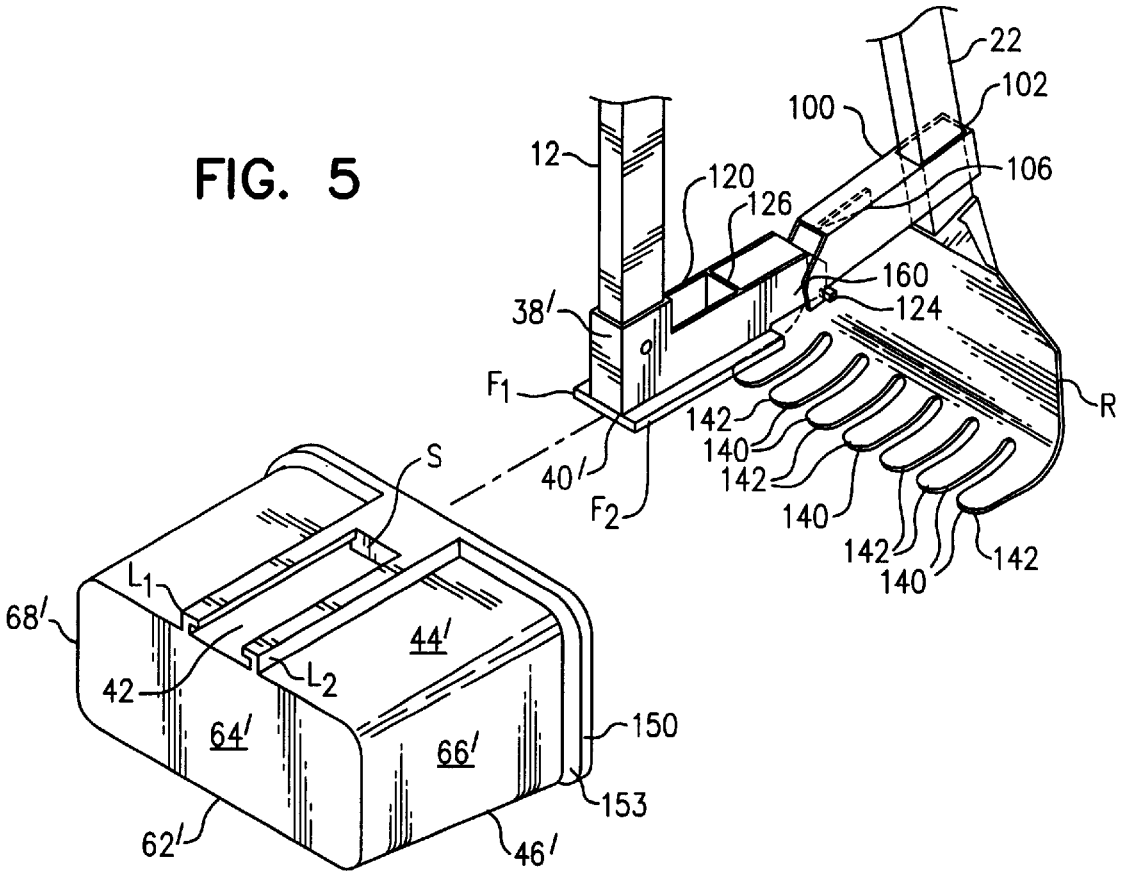
FIG. 5 is a partial perspective view of a second embodiment of my invention, using a gravity latch as just set forth in FIG. 4 above, and also showing a waste collection container with integral attachment keyway, as well as the shoe assembly and shoe plate to which the waste collection container is mounted.
Figure 6:
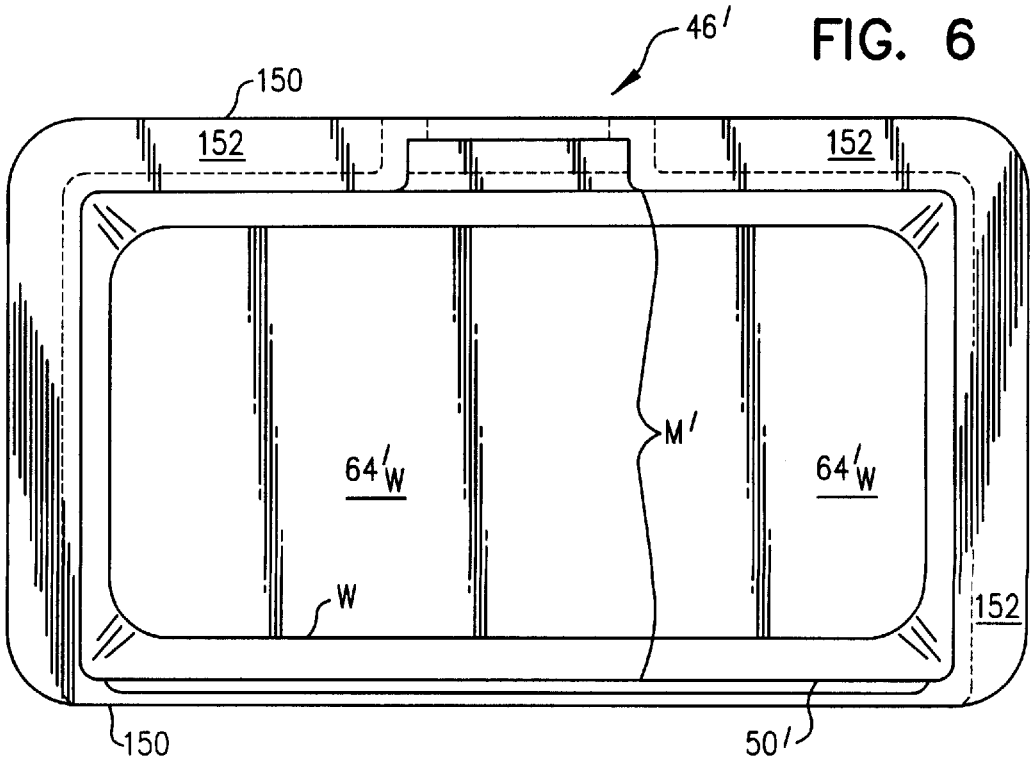
FIG. 6 is a front elevation view of the waste collection container just shown in FIG. 5.

My waste collection device is used to collect solid waste 56 by upwardly moving the downwardly biased handle 32 (which handle also biases the second strut 22 in an outward or open position) through an angle alpha ($\alpha$) sufficient to cause complete closure of the interface gap $I_g$ between the rake R and the container 46 (as noted in FIG. 4). I have found that an interface gap $I_g$ of about 4.5 inches to about 5 inches is generally sufficient to span most piles of dog feces. This corresponds to an angle alpha ($\alpha$) of up to about 12 degrees, more or less.

Figure 3:
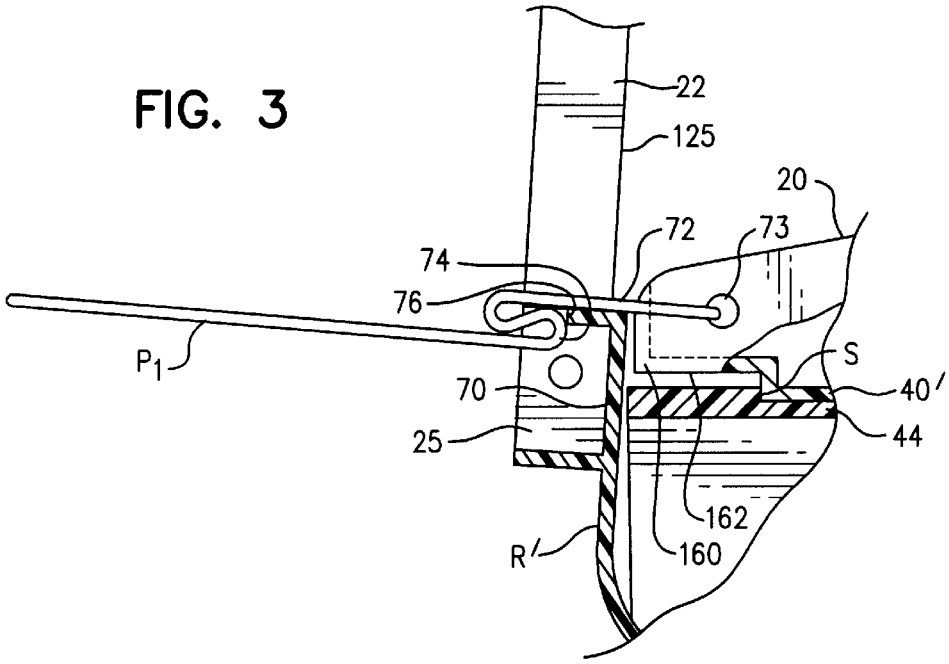
FIG. 3 is a partial cross-sectional view, enlarging upon a portion of the device just set forth in FIG. 2, now showing the detail of the gravity latch mechanism with the rake in a closed and locked position.

Once my waste collection device has been used to collect solid waste 56, in the manner just described, then a gravity latch 72 locks rake R in a closed position. In FIGS. 1, 2, and 3, a first embodiment of my gravity latch 72 is pivotally mounted from shoe assembly 20 at latch mounts 73, and extends inwardly toward the rake R. The gravity latch 72 has a downwardly extending pawl or catchment portion 74. The downwardly extending catchment portion 74 is adapted to interface with catch bar 76. Catch bar 76 is located on rake R, or preferably on rake attachment portion 70 of rake R, and interacts with catchment portion 74 so as to secure the rake R against opening motion, even though the rake R is biased in an opening direction, due to the action of spring 36 between handle 32 and handle assembly 16. Preferably, the gravity latch 72 is provided with a first prong $P_1$ and a second prong $P_2$, and the first prong $P_1$ and the second prong $P_2$ straddle the second strut 22, so as to form therebetween a guide for the second strut 22 to pass therethrough, and thus to form a guide for the rake R which is attached at the lower end of second strut 22, as the rake R is urged toward the waste collection container 46.

Figure 7:
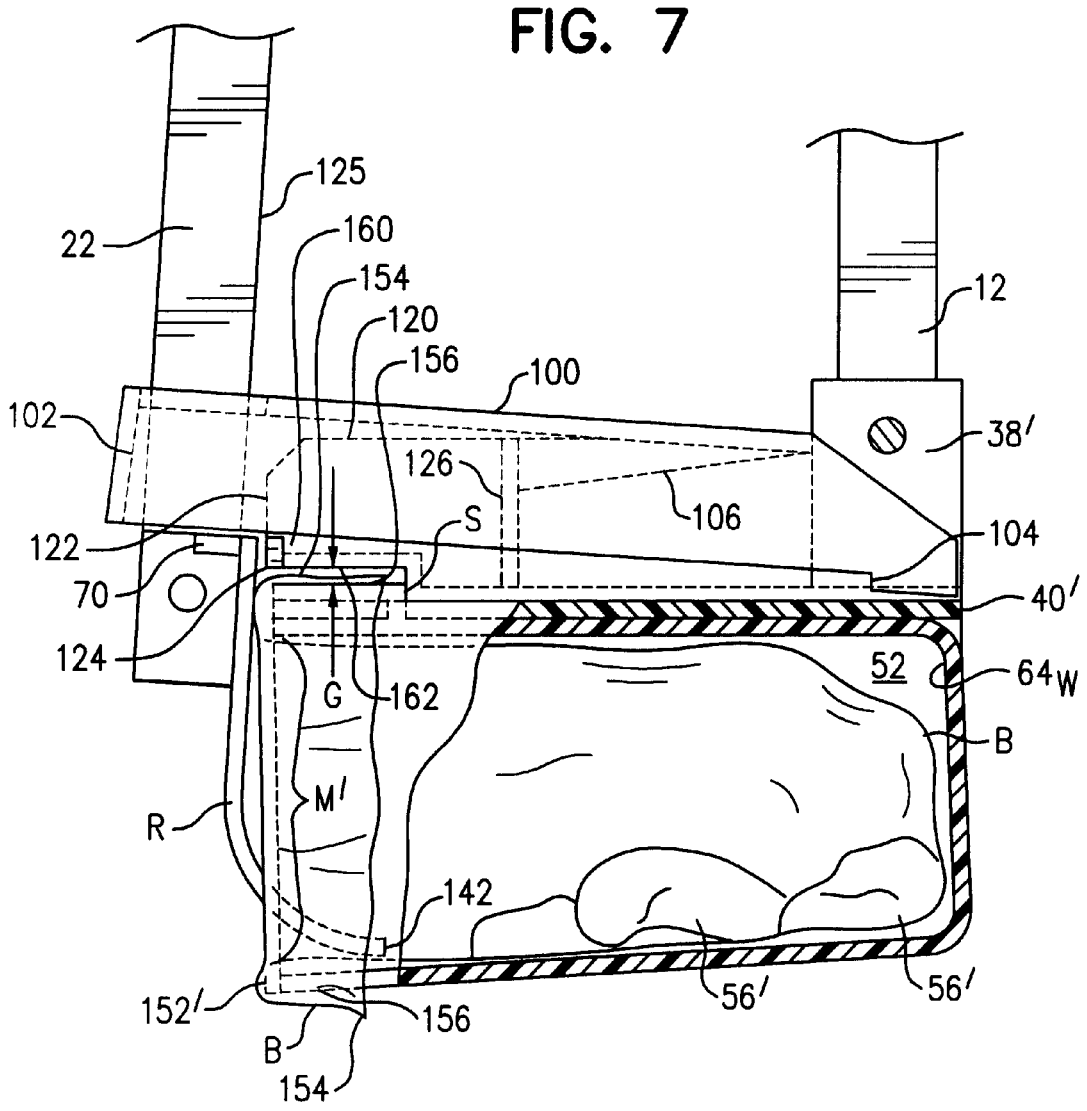
FIG. 7 is a partial cross-sectional view of the waste collection container shown in FIGS. 5 and 6 above, now shown with the waste collection device in a closed, locked position, after collection of feces in a plastic bag liner located within the waste collection container.

In an alternate embodiment illustrated in FIG. 4, a gravity latch 100 is provided with a slide housing portion 102, which is adapted to fit conformingly yet slideably around the second strut 22, so that the gravity latch 100 is free to slide longitudinally with respect to the second strut 22. In this alternate configuration, the gravity latch 100 is preferably provided with a distal pawl 104 and a closing, and preferably centrally located and downwardly extending, locking pawl 106. An alternate shoe assembly 120 has, at the distal end 122 thereof, a laterally extending stop 124 for securing the distal pawl 104. In the configuration shown in hidden lines in FIG. 4, the rake R is partially extended, by a distance O from the waste collection container 46, which distance is approximately the distance of the distal pawl 104 from the inside 125 of second strut 22. In order to lock rake R in a closed position as seen in solid lines in FIG. 4 (and in hidden lines in FIG. 7), the locking pawl 106 is adapted to interfittingly engage an upwardly extending rib 126 which is provided, preferably in integral, one-piece manufacture, in shoe assembly 120. In this manner, the gravity latch 100 makes it possible to secure rake R in a closed position, even though the rake R is biased toward an open position.

As best illustrated in FIG. 2, I prefer to provide a handle assembly 16 that has a downwardly opening handle receiving portion 130, and wherein the handle 32 is sized laterally and longitudinally for being received into the handle receiving portion 130 of the handle assembly 16. The lateral sizing of handle 32 for receipt of handle 32 into handle receiving portion 130 can be seen on a first or right side 132 of handle 32 in FIG. 1; the second or left side (not shown) is preferably a mirror image, structurally and operationally. Thus, when the handle 32 is pivoted upwardly into the handle receiving portion 130 of the handle assembly 16, biasing spring 36 is compressed, thus defeating the opening bias provided by spring 36. The handle assembly spring cage 134 and the complementary handle spring cage 136 are best seen in FIG. 2.

Also in FIG. 1, the rake R can be seen as preferably provided with a plurality of tines or teeth 140. The plurality of teeth 140 are curved toward the waste collection container, at a length and in a manner which enables efficient collection of solid waste 56 such as feces. Ideally, each one of teeth 140 which comprise the plurality of teeth 140 in the rake R is spaced downwardly and transversely, with respect to the second strut 22, and with respect to the bottom wall interior surface portion $\mathbf{62}_W$ of the waste collection container 46, or more specifically, with respect to the interior peripheral edge 50, so that each of the teeth 140 of rake R narrowly avoids interfering with the peripheral edge 50 or with the bottom wall/interior wall surface portion $\mathbf{62}_W$ of the waste collection container 46, as the rake R is moved toward the waste collection container 46 and ultimately to a closed position wherein the plurality of teeth 140 fit inside the waste collection container 46. In a preferred embodiment, I prefer to provide seven (7) teeth 140, each about three-eighths (3/8) of an inch wide and with about five-sixteenths (5/16) spacing therebetween, with the teeth having a radius of curvature $C_R$ of about one (1) inch (see FIG. 4) toward the waste collection container 46. In such cases, the waste collection container 46 is provided with about three (3) inches overall height K, and about four and one-half (4½) inches overall depth D.

The curvature of rake R is such that the teeth 140 are at a shallow angle relative to the ground during closure; in other words, at their distal end 142, the teeth 140 are preferably almost parallel to the ground. In this manner, the shallow angle between the teeth 140 and the ground 39 facilitates imparting a lifting or upward motion to the pile of waste 56 being moved into the waste collection container 46. The length and curvature of the teeth 140 of rake R, as herein described, are particularly important in achieving reliable recovery of feces from grass.

As seen in FIGS. 5, 6, 7, and 9, with my waste collection device 10, it is easy to use a disposable bag B to avoid soiling the enclosed container portion 52 of a waste collection container 46'. As noted in FIGS. 5 and 6, a waste collection container 46' may also have a pronounced perimeter edge portion 150 extending around the perimeter of mouth M', adapted for receiving therebehind a releasably securable disposable bag B. Perimeter edge portion 150 has a forward face 152 and a rearward face 153. Disposable bags B can be provided in the type having a lip portion 154 that is rearwardly directed about a forward portion 156 of the exterior of the waste collection container 46, so that a bag sized to substantially conform, when extended in an open manner, with the dimensions of the interior wall surfaces of the waste collection container 46, easily accommodates the solid waste raked thereto and so placed therein.

Use of a disposable bag B is enhanced by proper design of the shoe assembly 120. When provided for use with a disposable bag B, the shoe assembly (20 or 120) is provided with an upwardly spaced interior end portion 160. The upwardly spaced interior end portion 160 has a lower surface 162 which is set upward toward the handle assembly 16 and away by a gap distance G from the top wall surface 44 of the waste collection container 46 so that the disposable bag B may be easily affixed to the waste collection container. Distance G of about three-sixteenths of an inch (3/16") has been found reasonable.

Figure 8:
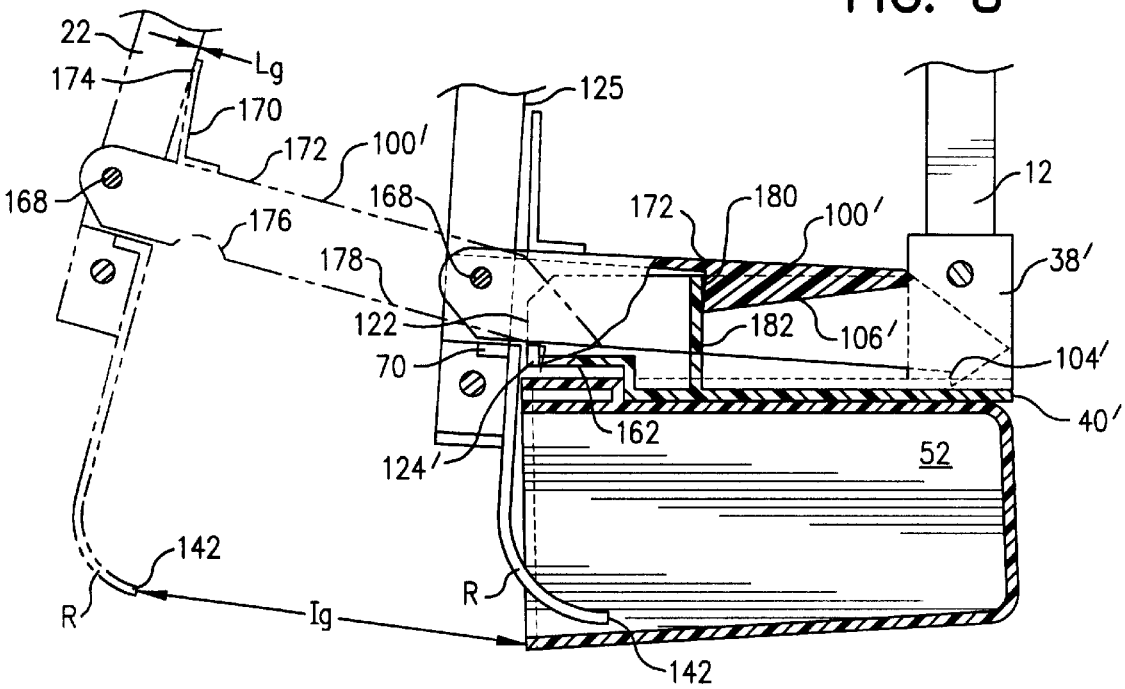
FIG. 8 is a partial cross-sectional view of my waste collection device in the open position, similar to the view first shown in FIG. 4 above, showing yet another embodiment of my gravity latch device.
Figure 9:
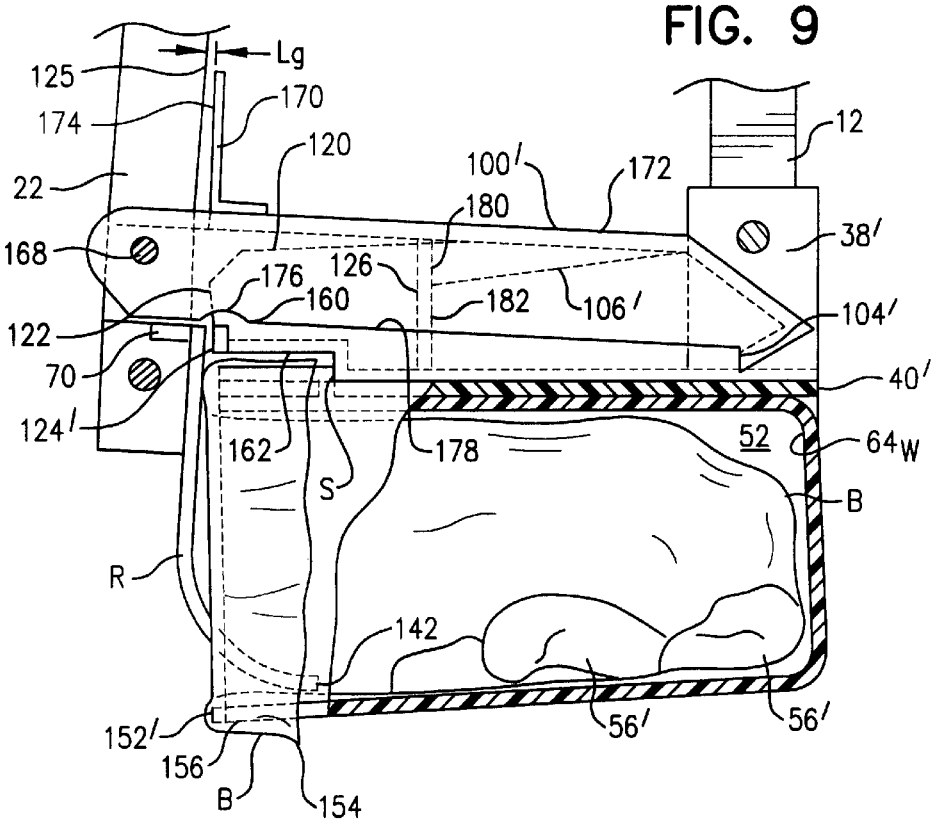
FIG. 9 is a partial cross sectional view of my waste collection container, now showing the gravity latch just illustrated in FIG. 8 in the closed, locked position after collection of feces when using a plastic bag liner.

Finally, turning now to FIGS. 8 and 9, it may often be advantageous to assure that a gravity latch 100' is biased downwardly, so as to ensure that the distal pawl 104' can be positively engaged with laterally extending stop 124'. One convenient structure for accomplishing this objective can be provided by pivotally mounting gravity latch 100' (at pivot 168) to strut 22, and providing a flexible, vertically extending, generally L-shaped spring 170 that is affixed to the upper surface 172 of latch 100'. This spring 170 is situated at a convenient location near strut 22, so that upon outward, arcuate motion of strut 22, at least a portion of the back 174 of spring 170 engages the inside surface 125 of strut 22 to firmly act on latch 100' to minimize further angular movement between the latch 100' and strut 22 when latch 100' is at a suitable angular position to engage stop 124', when interface gap $I_g$ is maximized so that the collection device 10 is in the open position. Using a simple, plastic spring 170 device in this manner, when the latch 100' is in the closed and locked position as noted in FIG. 9, there is a small gap $L_g$ between the back 174 of spring 170 and the inside surface 125 of strut 22. This gap $L_g$ disappears upon opening of the gravity latch 100', as seen in FIG. 8. Also, when latch 100' is in the closed position, a clearance notch 176, normally in circular segment form, is preferably provided by removal of a portion of the lower surface 178 of latch 100', to allow latch 100' to close without interfering with stop 124'.

In this embodiment of gravity latch 100', in order to lock rake R in a closed position as seen in partial cross-section in FIG. 8, (and in hidden lines in FIG. 9) the locking pawl 106' is adapted to interfittingly engage an upwardly extending rib 126 which is provided, preferably in integral, one-piece manufacture, in shoe assembly 120. Preferably, locking pawl 106' has an engaging surface 180 that rests against an inside surface 182 of rib 126 to secure latch 100'. As in other embodiments illustrated, the gravity latch 100' design makes it feasible to releasably secure rake R in a closed position, even though the rake R is biased toward a normally open position.

The waste collection device described herein provides improved ergonometric operation for a waste collection device. It will thus be seen that the objects set forth above, including those made apparent from the proceeding description, are efficiently attained, and, since certain changes may be made in carrying out the construction of a suitable apparatus to produce the desired waste collection device, while achieving the objectives as set forth herein, it is to be understood that the invention may be embodied in other specific forms without departing from the spirit or essential characteristics thereof. For example, while I have set forth exemplary designs for a gravity latch arrangement, many other embodiments are also feasible to attain the result of the principles of the apparatus and via use of the methods disclosed herein. Therefore, it will be understood that the foregoing description of representative embodiments of the invention have been presented only for purposes of illustration and for providing an understanding of the invention, and it is not intended to be exhaustive or restrictive, or to limit the invention to the precise forms disclosed. On the contrary, the intention is to cover all modifications, equivalents, and alternatives falling within the spirit and scope of the invention as expressed in the appended claims. As such, the claims are intended to cover the structures and methods described therein, and not only the equivalents or structural equivalents thereof, but also equivalent structures or methods. Thus, the scope of the invention, as indicated by the appended claims, is intended to include variations from the embodiments provided which are nevertheless described by the broad meaning and range properly afforded to the language of the claims, or to the equivalents thereof.

What is claimed is:

1. A waste collection device, said device for collection of solid waste from a substrate, said device comprising:

(a) a first strut, said first strut extending lengthwise from
  (i) a handle assembly end, to
  (ii) a shoe assembly end;

(b) a second strut, said second strut extending lengthwise from
  (i) a handle assembly end, to
  (ii) a rake end;

(c) a handle assembly, said handle assembly
  (i) fixedly affixed to said first strut, and
  (ii) pivotally attached to said second strut;

(d) a waste collection container, said waste collection container further comprising
  (i) a front interior peripheral edge defining a mouth for a rearward extending container portion defined by interior wall surfaces; and (ii) an attachment keyway;

(e) a shoe assembly, said shoe assembly comprising (i) a strut attachment portion, said strut attachment portion adapted to affix said shoe assembly to said first strut, and (ii) a shoe plate, said shoe plate adapted to interfittingly engage said attachment keyway of said waste collection container, to removeably affix said waste collection container to said shoe assembly;

(f) a rake, said rake attached to said rake end of said second strut, said rake mounted (i) lengthwise, with respect to said second strut, and (ii) laterally with respect to said mouth of said waste collection container, (iii) in a manner so that when said rake and said container are placed on opposing sides of solid waste resting upon said substrate, upon movement of said rake toward said waste collection container, the rake is in a position to effectively urge said solid waste toward said rearward extending container portion of said waste collection container.

2. The waste collection device as set forth in claim 1, wherein said waste collection container further comprises a top wall, and wherein said attachment keyway is formed by opposing inverted flanges (a) extending above at least a portion of said top wall, and (b) running longitudinally on either side of a centerline formed therebetween.

3. The waste collection device as set forth in claim 2, wherein said opposing inverted flanges are provided in opposing, inverted L-shapes.

4. The waste collection device as set forth in claim 2, wherein said attachment keyway is provided with said waste collection container in integral, one-piece, molded construction.

5. The waste collection device as set forth in claim 2, wherein said shoe assembly further comprises an upwardly spaced interior end portion, said upwardly spaced interior end portion having a lower surface set upward toward said handle assembly from said top wall of said waste collection container to provide a gap G between said lower surface and said top wall of said waste collection container, so that a disposable bag may be affixed to said waste collection container.

6. The waste collection device as set forth in claim 5, wherein said waste collection container further comprises an outer perimeter edge, said outer perimeter edge adapted to receive thereover, and secure therebehind, a disposable bag.

7. The waste collection device as set forth in claim 1, wherein said rake further comprises a rake attachment portion, said rake attachment portion adapted for tight fitting engagement with said rake end of said strut, so as to provide a guide for fixedly attaching said rake to said rake end of said second strut.

8. The waste collection device as set forth in claim 1, further comprising (a) a gravity latch, said gravity latch is pivotally mounted from said shoe assembly and extends toward said rake; (b) wherein said gravity latch further comprises a downwardly extending catchment portion; (c) wherein said rake further comprises a catch bar; and (d) wherein said downwardly extending catchment portion is adapted to releasably latch with said catch bar on said rake, so as to secure said rake against opening motion, when said rake is biased in an opening direction.

9. The waste collection device as set forth in claim 8, wherein said gravity latch further comprises a first prong and a second prong, and wherein said first prong and said second prong straddle said second strut, so as to form therebetween a guide for said second strut to pass therethrough, and thus to form a guide for the rake as it approaches said waste collection container.

10. The waste collection device as set forth in claim 8, wherein said gravity latch further comprises a slide housing portion, said slide housing portion adapted to slidingly fit said second strut, so that said gravity latch is free to slide longitudinally with respect to said second strut.

11. The waste collection device as set forth in claim 10, wherein said gravity latch further comprises a distal pawl, and wherein said shoe assembly further comprises a laterally extending stop, and wherein said distal pawl is adapted to interfittingly engage said stop, so as to secure said rake with respect to said waste collection container.

12. The waste collection device as set forth in claim 10, wherein said gravity latch further comprises a locking pawl, and wherein said shoe assembly further comprises a laterally extending rib, and wherein said locking pawl is adapted to interfittingly engage and releasably latch with said rib, so as to secure said rake in a closed position with respect to said waste collection container.

13. The waste collection device as set forth in claim 1, further comprising a handle, said handle fixedly attached to said second strut.

14. The waste collection device as set forth in claim 13, wherein said handle assembly further comprises a downwardly opening handle receiving portion, and wherein said handle is sized laterally and longitudinally for being received into said handle receiving portion of said handle assembly when said handle is pivoted upwardly toward said handle receiving portion.

15. The waste collection device as set forth in claim 14 wherein said handle is biased outwardly from said handle assembly toward an open position.

16. The waste collection device as set forth in claim 14, wherein said outwardly bias is provided by a spring.

17. The waste collection device as set forth in claim 1, wherein said rake further comprises a plurality of teeth, each of said teeth having a length and a distal end portion.

18. The waste collection device as set forth in claim 17, wherein each one of said plurality of teeth of said rake are curved toward said waste collection container by a radius of curvature $C_R$.

19. The waste collection device as set forth in claim 18, wherein each one of said plurality of teeth of said rake are spaced longitudinally, with respect to said second strut and with respect to said mouth of said waste collection container, so that said plurality of teeth of said rake narrowly avoid interfering with said waste collection container, when said rake is moved toward said waste collection container and to a closed position wherein said plurality of teeth fit inside said waste collection container.

20. The waste collection device as set forth in claim 17, wherein said radius of curvature $C_R$ is uniform throughout said length, and wherein said radius of curvature $C_R$ is approximately one inch (1").

21. The waste collection device as set forth in claim 1, further comprising a disposable bag, said disposable bag (a) removeably affixable to the periphery of the mouth of said waste collection container, and (b) having a lip portion adapted for being rearwardly directed about a forward portion of the exterior of said waste collection container, (c) said bag sized to substantially conform, when extended in an open manner, with the dimensions of said interior wall surfaces of said waste collection container, so as to accommodate solid waste raked thereto and so placed therein.

22. The waste collection device as set forth in claim 1, further comprising a pivot, said pivot operatively connecting said handle assembly with said second strut, and wherein said second strut is positionable between (a) a normally open, extended position, and (b) an angularly displaced, closed position, (c) so that said rake effectively form a cover for said mouth of said waste collection container.

23. The waste collection device as set forth in claim 1, wherein said handle assembly further comprises a strut attachment portion, and wherein said handle assembly is integrally formed with said strut attachment portion, so that said handle assembly and said strut attachment portion form a combination strut attachment portion and handle assembly.

24. The waste collection device as set forth in claim 1 wherein said second strut is displaceable from a first, open position to a second, angularly displaced, closed position by pivoting said second strut inward toward said waste collection container by an angle alpha ($\alpha$).

25. The waste collection device as set forth in claim 24, wherein said angle alpha ($\alpha$) is up to about twelve degrees (12°).

26. The waste collection device as set forth in claim 1, further comprising a gravity latch, said gravity latch pivotally mounted from said second strut and extending toward said first strut, and wherein said gravity latch further comprises (a) an upper surface;

(b) a vertically extending, generally L-shaped spring mounted to said upper surface, and (c) wherein said spring flexibly limits the upward pivotal motion of said gravity latch.

27. The device as set forth in claim 26, wherein (a) said gravity latch further comprises a downwardly extending locking pawl portion, and (b) wherein said shoe assembly further comprises an upwardly protruding transverse rib, and (c) wherein said locking pawl portion is adapted to interfittingly engage and releasably latch with said rib, so as to secure said rake in a closed position with respect to said waste collection container.

28. The waste collection device as set forth in claim 27, wherein said gravity latch further comprises a distal pawl, and wherein said shoe assembly further comprises a laterally extending stop, and wherein said distal pawl is adapted to interfittingly engage said stop, so as to secure said rake with respect to said waste collection container when said device is in an open position.

29. A waste collection device, said device for collection of solid waste from a substrate, said device comprising:

(a) a first strut, said first strut extending lengthwise from
  (i) a handle assembly end, to
  (ii) a waste collection container end, said waste collection container end further comprising an attachment shoe assembly;

(b) a handle assembly, said handle assembly fixedly affixed to said first strut;

(c) a second strut, said second strut pivotally attached to said handle assembly, and extending lengthwise from
  (i) a handle assembly end, to
  (ii) a rake end;
  (iii) so that said second strut is adapted for pivotal movement of said rake end toward said waste collection end of said first strut;

(d) a waste collection container, said waste collection container detachably affixed to said first strut, said waste collection container further comprising (i) a front interior peripheral edge defining a mouth, (ii) a top wall, said top wall further comprising an attachment keyway said attachment keyway and said attachment shoe assembly configured to interfittingly engage and detachably interlock each with the other; and (e) a rake, said rake attached to said rake end of said second strut, said rake further comprising finger portions, said finger portions mounted substantially in opposition to said mouth of said waste collection container, (f) whereby when said rake and said waste collection container are placed on opposing sides of a specimen of solid waste resting upon said substrate, upon movement of said rake toward said waste collection container, said rake effectively urges said solid waste toward said mouth and thence toward said rearward extending container portion of said waste collection container.

30. The waste collection device as set forth in claim 29, wherein said shoe assembly further comprises a strut attachment portion, said strut attachment portion adapted to affix said shoe assembly to said first strut.

31. The waste collection device as set forth in claim 30, wherein said shoe assembly further comprises a shoe plate, said shoe plate adapted to interfittingly engage said attachment keyway of said waste collection container, to removeably affix said waste collection container to said shoe assembly.

32. The waste collection device as set forth in claim 29, wherein said attachment keyway further comprises opposing inverted flanges, said opposing inverted flanges extending above at least a portion of said top wall, and running longitudinally equilaterally from a centerline formed therebetween.

33. The waste collection device as set forth in claim 32, wherein said opposing inverted flanges are provided in an opposing, inverted L-shape.

34. The waste collection device as set forth in claim 32, wherein said attachment keyway is provided with said waste collection container in an integral, one-piece manner.

35. The waste collection device as set forth in claim 29, wherein said rake further comprises a rake attachment portion, said rake attachment portion adapted for tight fitting engagement with said rake end of said second strut, so as to provide a guide for fixedly attaching said rake to said second strut.

36. The waste collection device as set forth in claim 29, further comprising (a) a gravity latch, said gravity latch pivotally mounted from said shoe assembly and extending toward said rake, and wherein said gravity latch further comprises a downwardly extending catchment portion; and (b) wherein said rake further comprises a catch bar; and (c) wherein said downwardly extending catchment portion of said gravity latch is adapted to releasably latch said catch bar on said rake, so as to secure said rake against opening motion, when said rake is biased in a closed direction.

37. The waste collection device as set forth in claim 36, wherein said gravity latch further comprises a first prong and a second prong, and wherein said first prong and said second prong straddle said second strut, so as to form therebetween a guide for said second strut to pass therethrough, and thus to form a guide for said rake as it approaches said waste collection container to urge solid waste into said mouth of said waste collection container.

38. The waste collection device as set forth in claim 29, further comprising a handle, said handle fixedly attached to said second strut.

39. The waste collection device as set forth in claim 38, wherein said handle assembly further comprises a downwardly opening handle receiving portion, and wherein said handle is sized laterally and longitudinally for being received into said handle receiving portion of said handle assembly when said handle is pivoted upwardly toward said handle receiving portion.

40. The waste collection device as set forth in claim 39, wherein said handle is biased outwardly from said handle assembly toward an open position.

41. The waste collection device as set forth in claim 39, wherein said outwardly bias is provided by a spring.

42. The waste collection device as set forth in claim 29, wherein said rake further comprises a plurality of teeth, each of said teeth having a length and a distal end portion.

43. The waste collection device as set forth in claim 42, wherein each one of said plurality of teeth of said rake are curved toward said waste collection container by a radius of curvature $C_R$ of approximately one inch.

44. The waste collection device as set forth in claim 29, wherein said shoe assembly further comprises an upwardly spaced interior end portion, said upwardly spaced interior end portion having a lower surface set upward toward said handle assembly from said top wall surface of said waste collection container to provide a gap G between said lower surface and said top wall of said waste collection container, so that a disposable bag may be easily affixed to said waste collection container.

45. The waste collection device as set forth in claim 29, wherein said second strut is displaceable from a first, open position to a second, angularly displaced, closed position by pivoting said second strut inward toward said waste collection container by an angle alpha ($\alpha$), and wherein said angle alpha ($\alpha$) is up to about twelve degrees (12°).

* * * * *